United States Patent [19]

Goessler et al.

[11] Patent Number: 4,700,051

[45] Date of Patent: Oct. 13, 1987

[54] RADIANT HEATER FOR COOKING APPLIANCES

[75] Inventors: Gerhard Goessler; Felix Schreder, both of Oberderdingen; Eugen Wilde, Knittlingen, all of Fed. Rep. of Germany

[73] Assignee: E.G.O. Elektro-Geräte Blanc u. Fischer, Fed. Rep. of Germany

[21] Appl. No.: 777,365

[22] Filed: Sep. 18, 1985

[30] Foreign Application Priority Data

Sep. 22, 1984 [DE] Fed. Rep. of Germany ..... 3434839
Feb. 4, 1985 [DE] Fed. Rep. of Germany ..... 3503648

[51] Int. Cl.[4] ..... H05B 3/68

[52] U.S. Cl. ..... 219/464; 219/466; 219/470; 219/483

[58] Field of Search ..... 219/464, 465, 466, 470, 219/476, 471, 472, 477, 483, 484

[56] References Cited

U.S. PATENT DOCUMENTS 3,375,346 9/1965 Gaugler et al. .
3,407,285 10/1965 Jacobs .
3,792,230 2/1974 Ray .

FOREIGN PATENT DOCUMENTS 0117346 5/1984 European Pat. Off. ..... 219/464
0027976 12/1959 Fed. Rep. of Germany .
1807660 12/1959 Fed. Rep. of Germany .
2045357 9/1970 Fed. Rep. of Germany .
2820114 5/1978 Fed. Rep. of Germany .
2557133 5/1978 Fed. Rep. of Germany .
3229380 8/1982 Fed. Rep. of Germany .
3204760 8/1982 Fed. Rep. of Germany .
1212941 11/1970 United Kingdom .
908793 11/1970 United Kingdom .
2132060 9/1980 United Kingdom .
2071969 9/1981 United Kingdom .
1273023 9/1981 United Kingdom .
2087698 5/1982 United Kingdom ..... 219/464

*Primary Examiner*—E. A. Goldberg
*Assistant Examiner*—Lincoln Donovan
*Attorney, Agent, or Firm*—Steele, Gould & Fried

[57] ABSTRACT

A radiant heater for cooking appliances with a glass ceramic plate has both bright light-radiating heating elements such as high temperature halogen lamps emitting substantial radiation in the visible range, and also darker glowing radiating elements operable at lower temperatures and radiating emitted light primarily in the infrared region. The bright visible light radiating element and the darker infrared glowing elements are connected in series with one another, whereby the series resistance of the dark or infrared radiator limits initial current loading, and after the radiant elements reach operating temperatures, the infrared radiant element assumes a reduced portion of the total resistance. The visible light and glowing infrared series-connected elements can be interleaved or the visible element can define a boundary for a cooking element. The bright visible and darker glowing elements can be defined by a plurality of elements connectable in parallel and series combinations by a seven-mode switching control, and can be embodied in a variety of configurations in which the visible light and infrared glowing elements are operable or are selectably operable.

35 Claims, 41 Drawing Figures

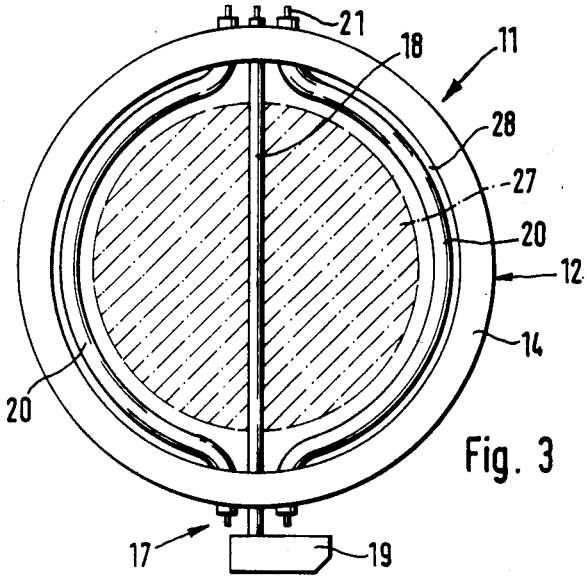
Fig. 3
Fig. 4a
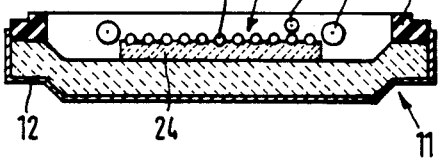
Fig. 5a
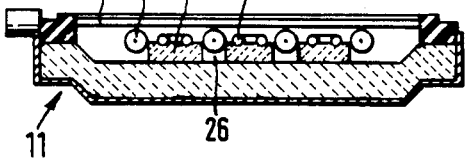
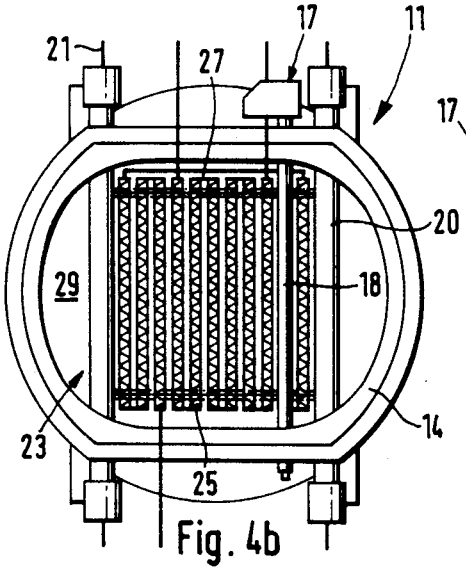
Fig. 4b
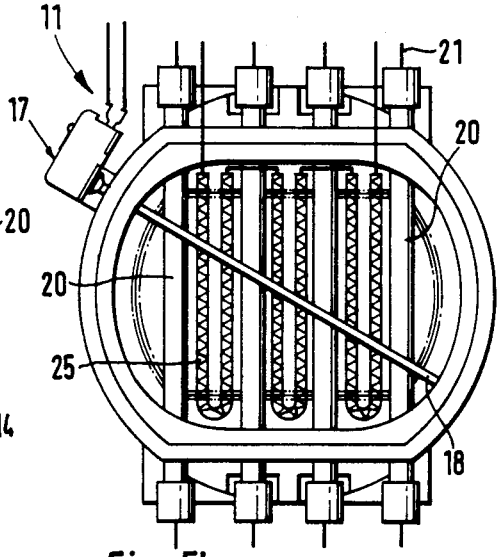
Fig. 5b Fig. 6a
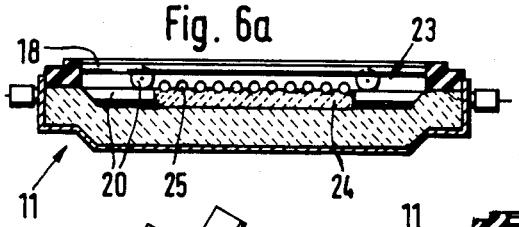
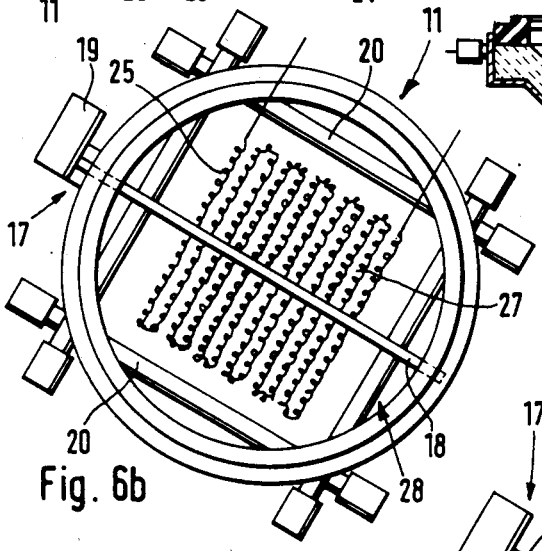
Fig. 6b
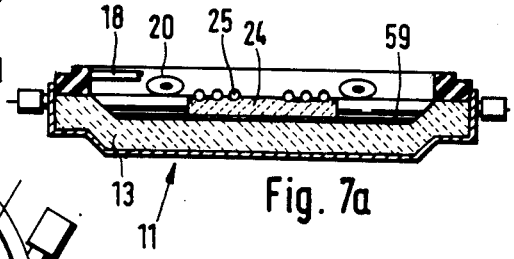
Fig. 7a
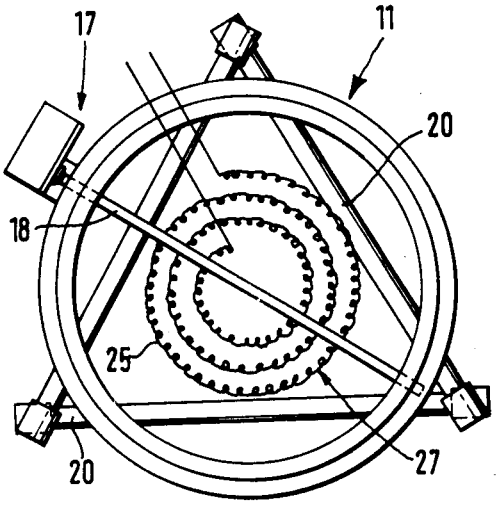
Fig. 7b
Fig. 8a
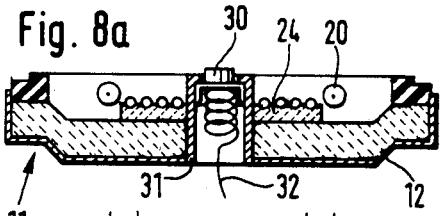
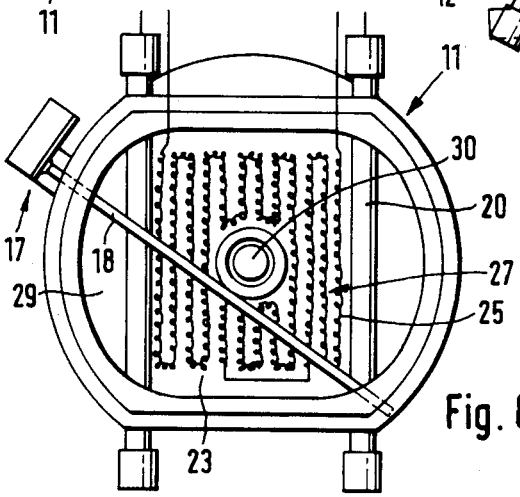
Fig. 8b

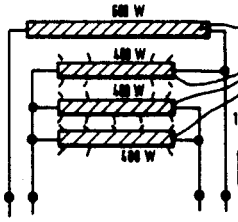
Fig.16a
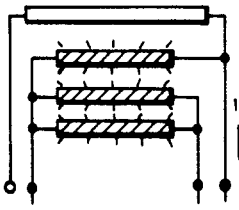
Fig.16b
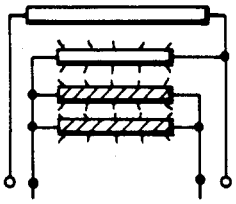
Fig.16c
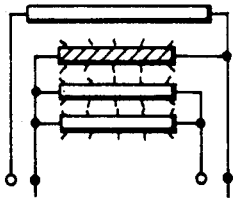
Fig.16d
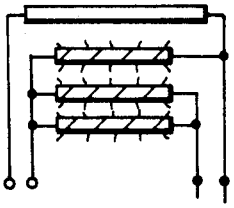
Fig.16e
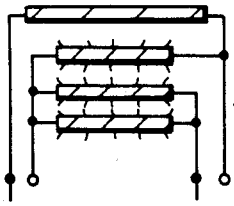
Fig.16f
Fig.17a
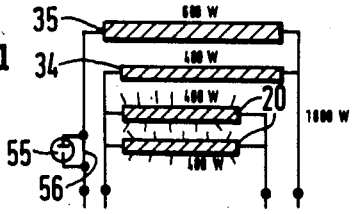
Fig.17b
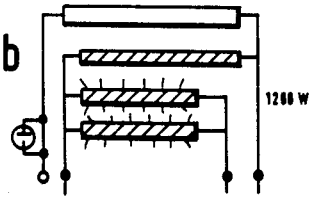
Fig.17c
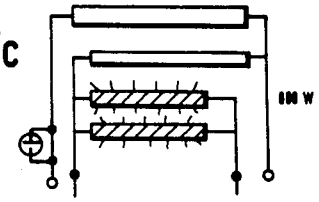
Fig.17d
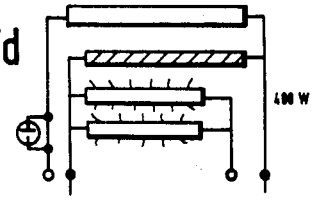
Fig.17e
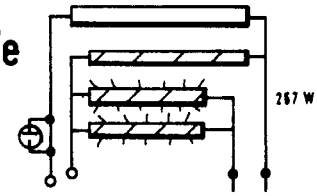
Fig.17f
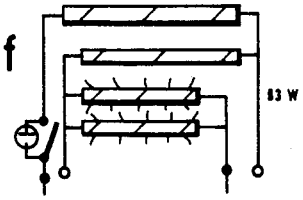

RADIANT HEATER FOR COOKING APPLIANCES

SUMMARY OF THE INVENTION

The present invention relates to a radiant heater for cooking appliances with a glass ceramic plate, with bright electrical light radiating heating elements, which operate at elevated temperatures above 1500 K. (approximately 1200° C.) and whose radiation spectrum extends significantly into the visible range.

Such radiant heaters are e.g. known from British Pat. No. 1,273,023. As light radiating heating elements, they have halogen lamps, which emit their radiant energy in the visible and infrared range and consequently penetrate a glass ceramic plate by radiation. As a result of the low thermal mass, the heating up times are very short and as a result of the light emission, the operator also is able to easily see whether a heater element is functioning. However, the controllability in the lower power range is difficult and in part requires the switching on of power diodes. In addition, the switch-on or starting currents are often very high, because the resistance materials of the light radiating elements have a relatively high positive temperature coefficient. Good control may require a large number of light radiators, which adds to the costs of a radiant heater.

The problem of the invention is to provide radiant heaters which utilize the advantages of bright visible light radiating elements, while having good controllability and reasonable economic costs.

According to the invention, apart from at least one of these bright visible light radiators, the radiant heater also has at least one heating zone with a radiant heating element operating at temperatures below 1500 K. (approximately 1200° C.), which cana be switched in simultaneously and/or alternately with the light radiator. This latter radiant element radiates primarily at longer wavelengths and is dark or just glows red in the visible range. The two types of elements are distinguished herein as "bright" or "light" (referring to high temperature visible-light emitting elements), and "glowing" or "dark" (referring to lower temperature radiators emitting primarily in the infrared region).

Whereas light radiators are preferably halogen radiators, which are constructed as an elongated or bent tube, it is also possible to use a resistance material based on molybdenum disilicite ($MoSi_2$), which, without the quartz glass encapsulation of the halogen lamp, can reach glow or incandescence temperatures in the light visible range. In particular the latter resistance material, which is commercially available under the trade name Kanthal-Super and has a glassy structure, has a very high starting current, because its resistance is very low at low temperatures. It is advantageous for at least one glowing-type radiator to be connected in series upstream of the bright light radiator, which largely operates only in the upper initial boiling or cooking and roasting power range, while preferably only in the lower cooking or boiling power range switching on the glowing or dark radiators, optionally heated in pulsewise manner by a timing power control device. For as long as the resistance of the light radiator is still low, the dark radiator acts as a series resistor, whose proportion in the total resistance becomes ever smaller with rising resistance of the light radiator during the heating thereof. Thus, there is an automatic power displacement from the dark radiator to the light radiator, whilst simultaneously reducing the starting current to an acceptable value. Preferably two dark radiators are provided, which are connected in parallel upstream of the light radiator, but are connected in series in the further cooking or boiling power range, where they alone are responsible for the heating. The radiator herein called dark radiator preferably consists of conventional filaments which are generally in coil form and are made from an iron - chrome - aluminium material. It is possible to use a material commercially available under the trade name Kanthal-A. Its glow temperatures should preferably be kept below 1500 K. (approximately 1200° C.) and are normally max. 1350 K. (approximately 1100° C.). It glows the visible spectrum, but its radiation output takes place primarily in the long wave range, whereas the heating elements called light or bright radiators here generally reach permitted maximum temperatures which are well above the aforementioned temperature limits and in part reach or exceed 2000 K. (approximately 1700° C.). However, it is also possible to partly drop below the above temperatures in the regulated down state.

Particular preference is given to an arrangement, in which the dark radiators are arranged in the central region of the radiant heater, which is surrounded by a ring area receiving the light radiators. This leads to the cooking zone being visibly restricted on the glass ceramic plate. Ideally a ring-shaped or annular light radiator would be used, which would surround the dark radiator heater zone in annular manner. It is possible with the molybdenum disilicite heating elements, which can e.g. be arranged in meandering shapes in such a ring area, but it is difficult from the manufacturing standpoint to produce halogen radiators in this shape with an adequate life. Thus, light radiators in multiangular form, e.g. in triangular or square form, can be placed round the dark radiator area.

However, if a uniform distribution of the light radiators over the entire cooking area is desired, then between the light radiators projecting through the roughly circularly heated area of the radiant heater, areas provided with darker glowing radiators are preferably provided and advantageously the light radiators are positioned in the vicinity of the gaps or depressions in a plane carrying the glow radiators. Thus it is possible to keep the overall height of the radiant heater low, because halogen light radiators generally have a larger diameter than the conventional heating coils of the dark type radiators so that they can be better kept in one plane by the aforementioned gap arrangement.

The glow radiators can be fixed to strip or plate-like insulating supports by partial embedding, the insulating supports being placed parallel between the light radiators. Embedding can take place in conventional manner, but preferably in accordance with German Pat. No. 27,29,929, the heating coils only being fixed over part of their length and/or size by pressing parts of the coil into the insulating material prior to its final curing.

Although encapsulated light radiators, e.g. halogen radiators, generally have their own reflection coating on the quartz glass envelope thereof, a marked efficiency improvement is obtained if the insulator is provided on its surface with a reflecting coating, preferably a titanium dioxide coating.

Although when using light radiators the glass ceramic plate is no longer heated to such an extent, particularly if it is made from a regularly permeable material for the specific radiation range, a temperature limiting means should be provided due to the risk of thermal damage to the glass ceramic material, and for this purpose a rod-like heat sensor can be used. It can be mainly arranged in the glow radiator region, because the greatest overall height is available therein. If, in a preferred manner, it is juxtaposed parallel to a light radiator, it detects the dark radiator temperature directly, but is laterally also influenced by the light radiator and leads to no significant increase in the overeall height. The temperature limiter can be connected in such a way that it switches off the dark radiator and allows the light radiator to provide the residual power. This ensures that there is only a limited risk of overheating of the glass ceramic plate, but the switching contacts of the temperature limiter have to switch the light radiator with its relatively high starting current. It is also possible to insert the light radiator in a special initial cooking circuit as is known for other hotplates from German Offenlegungsschrift No. 31,44,631, to which reference is made here. In the latter, the temperature switch is provided with a temperture corresponding to an initial cooking temperature and such a high switching delay that it normally does not switch on again after being switched off once during the operation of the radiant heater. It switches off the light radiator after a certain initial cooking phase, so that an automatic initial cooking circuit is obtained.

As a result of the combination between light and dark radiators, there is a significant improvement to the regulating and control possibilities of the radiant heater. When using a timing power control device, which supplies the radiant heater with energy in individual power pulses of varying relative on-time, the power control device can be provided with an additional switch switchable by means of a setting shaft of the power control device and which is preferably contained in an adaptor switch and which is switched on by at least one light radiator in an upper power range, particularly in the case of a power setting of a power control device of 100% relative on-time. Thus, here the light radiator is only switched on in the upper power range and is consequently used for rapid initial heating, for which purpose it is particularly suitable. Its total on-time remains low, so that this relatively expensive component with a limited life is protected. There is also no switching on and off of the light radiator, which is advantageous due to the increased starting current, the life reduction in the case of frequent switching on and off and the uncertainty caused to the operator as a result of the alternating lighting up and darkening of the heating zone, together with the reduced mains loading and ratio interference. Most of these advantages can also be achieved if, in the medium and lower power range, a series connection of light and dark radiators is supplied in timed manner with power by a power control device.

However, it is also advantageously possible to control the power of the radiant heater with several light radiators and at least one dark radiator via a multi-mode control circuit, preferably a seven-mode circuit, with selectable parallel, individual and series connection of the radiators. Light radiators are then connected in most intermediate stages, so that there is always a visual check for the user, however, with the smaller number of light radiators a better power grading, particularly in the lower range, is possible.

In order in the case of good thermal insulation to provide good contrast confining emissions of the radiant heater in the cooking appliance, it is possible to provide a radiation shield in the marginal area. It can be formed by an annular insulating mask which, located on the edge, is pressed against the cooking surface and is cut out in relatively sharp edge manner, because it is preferably made from a denser, but thermally stable unsulating material. If it projects inwards over the actual edge made from highly insulating, but not strong material, then it alone will determine the optical action of the cooking zone and it is ensured that the cooking surface does not have a "frayed" appearance, due to a poorly defined inner limitation thereof. In addition to or in place of the mask, radiation shielding can also comprise a light-absorbing or reflecting coating on the connection ends of the light or bright radiator. This ensures that light from the ends of said radiator does not penetrate to the area of the cooking appliance outside the actual cooking points, and that the glass ceramic plate is not also subject in this area to generally non-uniform illumination from below, which is optically disturbing and would lead to undesired heating of the cooking appliance.

Radiation shielding can also be provided by a cover for the connecting end of the light radiator heating element, which can form part of the insulation and is in particularly preferred manner part of the insulating mask. However, preference is given to a combination of these measures.

The radiation shielding and the linked measures can also be advantageously used in connection with a radiant heater having light or bright radiators alone and without any dark radiators.

This and further features of preferred embodiments of the invention can be gathered from the description and drawings, the individual features being realisable individually or in the form of subcombinations in embodiments of the invention.

BRIEF DESCRIPTION OF THE DRAWINGS

The invention is described in greater detail hereinafter relative to non-limitative embodiments and the attached drawings, wherein show:

FIG. 3 a diagrammatic plan view of a variant.

FIGS. 4 to 8 further variants, "a" indicating a vertical section through the radiant heater and "b" a plan view.

FIGS. 16 and 17 the circuit of in each case four heating devices provided in a radiant heater by means of a conventional seven-mode switch (not shown) in the six different power stages (a to f).

DETAILED DESCRIPTION OF THE PREFERRED EMBODIMENTS

Figure 1:
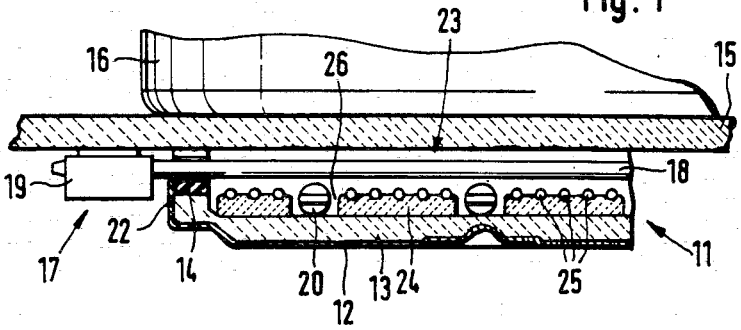
FIG. 1 a vertical partial section through a glass ceramic plate with a radiant heater positioned below it.

In all the represented embodiments, and consequently also in FIG. 1 described hereinafter, the following elements are provided. In a flat sheet metal tray 12 is arranged insulation 13 on whose edge area is placed a ring 14 made from a somewhat stronger insulating material then layer 13, which engages on the bottom of the glass ceramic plate. Radiant heater 11 heats through the glass ceramic plate 15 a cooking utensil 16 standing thereon. A temperature limiter 17 with a rod-like heat sensor 18 projects over the heater area of the radiant heater and contains in its switch head 19 located outside the region of tray 12, switches which influence the power supplied to the radiant heater and switch some or all of the heating elements on and off. In the remaining embodiments, these elements are given the same reference numerals will not be described again.

Figure 2:
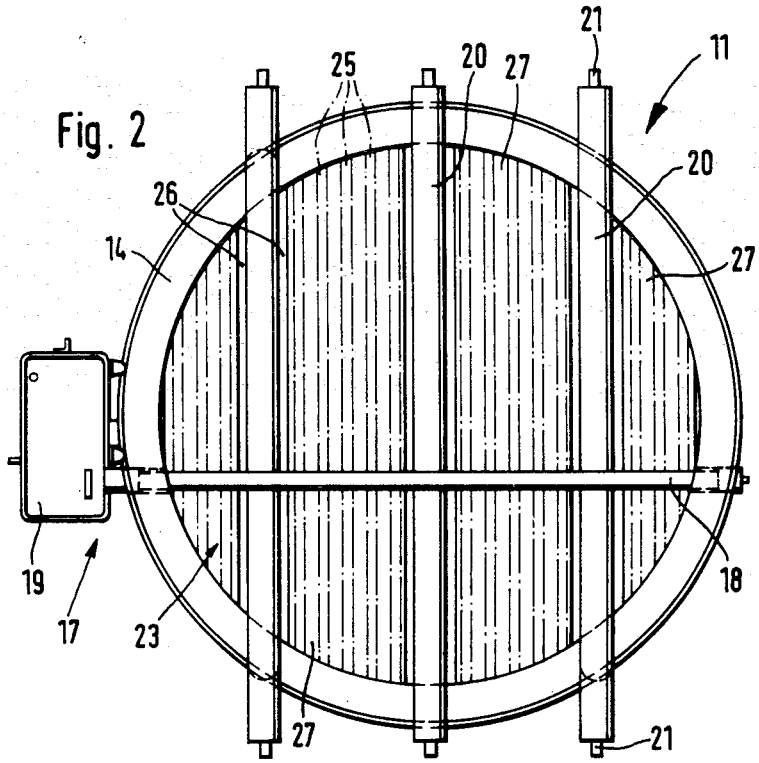
FIG. 2 a diagrammatic plan view of a radiant heater.

In the construction according to FIGS. 1 and 2, there are three light or bright radiators 20, which are constructed as straight halogen lamps, which e.g. contain a tungsten filament, contained in a quartz glass tube in a halogen atmosphere and supported by intermediate webs. Such radiators are described in British Pat. No. 173,023, to which reference is made. The filament thereof operates at temperatures of around 2400 K. (2700° C.) and, apart from an infrared portion, also produces a high proportion of visible light in the white range. Glass ceramic plate 15 is allows at least the partial passage of this spectral range, while part of the radiant heat energy in the glass ceramic plate is absorbed and transferred by contact and conduction to the cooking utensil 16. On both sides the light radiators 20 are provided with terminals 21, which project over the edge 22 of the sheet metal tray 12 and are connected there with corresponding leads. The three light radiators 20 project by their ends through edge 14 and are located with their radiant area within the circularly heated surface 23 of the radiant heater, formed in the dish-shaped interior of the latter. The three light radiators project in parallel and with the same reciprocal spacing over the heated area. Between them are inserted insulating material strip-like insulating supports 24, on whose top are fixed conventional dark type radiator heating elements 25. The latter comprise heating coils of resistance wire, e.g. an iron - chrome - aluminium alloy, which can be used up to temperatues of approximately 1500 K. (1200° C.). They are partly embedded in the surface of insulating support 24, in that the lower part of their turns are pressed in spaced manner, or over the entire length into the insulating support prior to the curing thereof. However, other fastening possibilities exist, e.g. using metal pins, cement, etc.

The strip-like insulating supports 24 leave gaps 26 between them and in said gaps are placed light radiators. Thus, the complete heating system roughly comprises one plane, although the light radiators have a larger external diameter than the heating coils. The dark radiators 25 indicated by dot - dash lines in FIGS. 2 and 3, form two dark radiator heating zones 27 between the three light radiators and can additionally also form in each case one dark radiator heating zone 27 on either side of the external light radiators, although this is not necessary. The heating coils are placed in zig-zag form on the insulating supports and their connecting ends are led out of the radiant heater by insulating bushings in a conventional manner.

FIG. 3 shows a radiant heater 11, in which the dark radiator heating zone 27 which can also be subdivided into a plurality of individually switchable heating resistors, assumes a circular, relatively large central region, which is surrounded by a light radiator heating zone 28 in the form of a circular ring. Two light radiators 28 in the form of halogen lamps are arranged therein and their radiation range occurs in a roughly semicircular manner whilst the connection ends are constructed facing and aligned with one another and project outwards through edge 14. Sensor 18 is positioned diametrically and substantially parallel to the connection ends, so that it detects the temperature of the dark radiator heating zone 27 in an optimum manner and is less influenced by the light radiators.

The embodiments according to FIGS. 4 to 8 in each case have the aforementioned dark radiators 25 on an insulating support 24. In FIG. 4 there are two light radiators 20 on either side of a central, rectangular dark radiator heating zone 27, so that a rectangular heating field is obtained, located in a radiant heater with a circularly defined edge, which is somewhat flattened on two sides. The circular segmental areas 29 free from the heaters are influenced by the radiation of the light radiators 20 inside of shielding defined by edge 14. The rod-like heat sensor 18 of temperature limiter 17 on one side with respect to heating zone 27 passes parallel to one of the light radiators 20 over the heated area 23 and from below receives the radiation of dark radiator 25 and from one side the radiation of light radiator 20.

FIG. 5 shows a construction, in which the four light radiators 20 are arranged parallel to one another in the form of straight rods. Between them and in each case on strip-like insulating supports 24 are arranged dark radiators 25, which are in each case connected in series by a connection, which passes through under the light radiator 20. Each insulating support 24 carries two parallel, linearly arranged heating coils. The light radiators are arranged in the gaps 26 between insulating supports 25 and the heat sensor 18 of temperature limiter 17 slopes diagonally over the light radiator and dark radiator areas.

FIG. 6 shows a construction, in which the four straight, rod-like heat radiators 20 are arranged in the form of a square in such a way that their radiating areas are located within the heated area 23 of the circular radiant heater. The height of adjacent light radiators is reciprocally displaced in such a way that they cross one another in the vicinity of the connecting ends and are consequently easily connectable. The rectangular, preferably square and closed central region is constructed as a dark radiator zone 27 and is provided in zig-zag manner with heating resistor coils. Thus, the light radiators form a light radiator heating zone 28 surrounding the dark radiator heating zone 27.

FIG. 7 shows a comparable arrangement, in which the three straight rod-like radiators 20 are arranged in the form of an equilateral triangle in much the same way as in FIG. 6. The triangular central zone enclosed by them is the dark radiator heating zone in which a dark radiator heating coil 25 is arranged in the form of a spiral. A titanium dioxide coating 59 is applied to the insulating layer 13 below the light radiators 20 and leads to a good reflection of the radiation of the light radiators.

FIG. 8 shows a construction, in which the light and dark radiators are arranged as in FIG. 4. However, in the center of the dark radiator heating zone 27 is provided a heat sensor 30 in the form of a circular, flat sensor box, which is arranged in a central sleeve 31 projecting from below through the radiant heater and which is pressed resiliently upwards against the glass ceramic plate. The sensor box 30 is filled with an expansion fluid and is connected by means of a capillary tube 22 to an expansion box in a heat sensor (not shown). It senses the temperature of the bottom of the glass ceramic plate, and from there also receives a feedback from the cooking utensil. It is used for temperature control as a function of the temperature and a value set on the temperature regulator, whilst the temperature limiter 17 has a fixed setting and is only switched off when there is a risk of overheating. Its heat sensor 18 has a diagonal configuration, but as a result of the heat sensor 30 is positioned somewhat eccentrically over the heated zone 29. Sensor 30 could also be located in the edge area 29, because there it is possible to provide a better coupling to the bottom of the cooking utensils.

Figure 9:
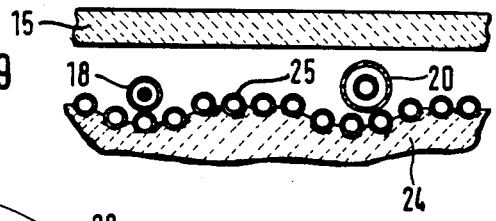
FIG. 9 a section through a detail of a variant.

FIG. 9 shows an arrangement of the dark radiator 25 on an insulating support 24 which is provided with depressions at points for the positioning of light radiator 20 and heat sensor 18 of the temperature limiter and which also contain dark radiators, so that they pass through below the light radiators and the heat sensor to a reduction in the overall height.

Figure 10:
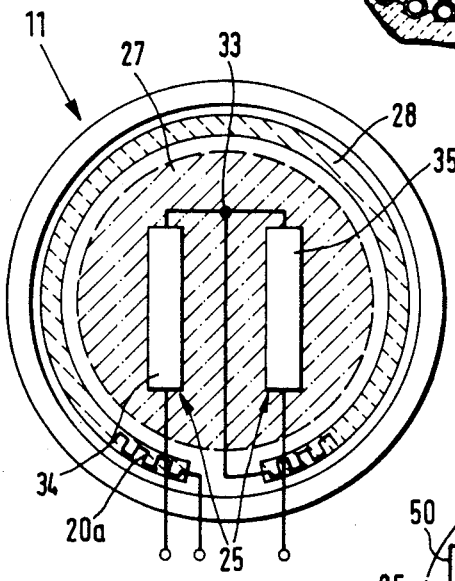
FIG. 10 a diagrammatic plan view of a radiant heater partly in a circuit diagram form.
Figure 11:
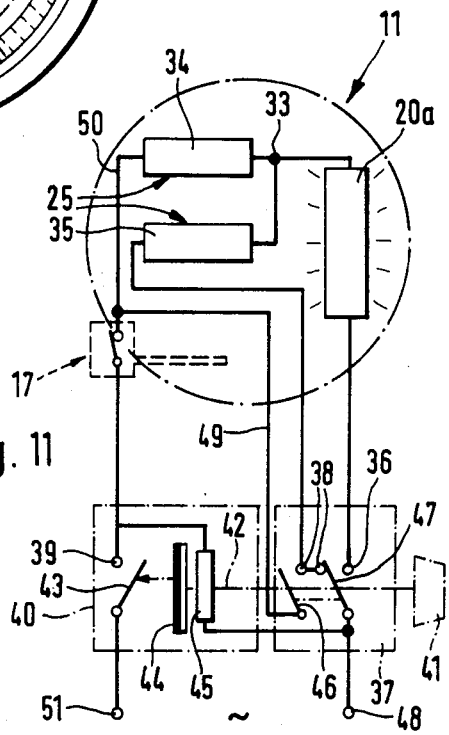
FIG. 11 the associated circuit diagram with a timing power control device.

FIGS. 10 and 11 show an arrangement in which the dark radiator heating zone 27 is surrounded in circular manner by a light radiator heating zone 28. In this construction, light radiator 20*a* is constructed as a meandering strip or wire of a molybdenum disilicite-based resistance material arranged in an annular light radiator heating zone 28 indicated in broken line form.

The dark radiator heating element 25 occupying the dark radiator heating zone 28 is subdivided into two heating resistors 34, 35 on a center tap 22, upstream of which is connected the light radiator 20*a*. The other pole of the latter is connected to a terminal 36 of an adaptor switch 37. Heating resistor 35 is located on another pole 38 of the adaptor switch and heating resistor 34 is connected across a temperature limiter 17 to the output pole 39 of a power control device 40. The latter is represented as a timing, thermally operated power control device with a setting knob 41 and a setting shaft 42 and contains a switch 43, preferably a snap switch, operated by a bimetal element 44, heated by a control heating means 45. The latter is positioned parallel to the heating resistors of radiant heater 11 and is switched on and off together therewith. The power provided, i.e. the amount of the relative on-time of switch 42 is determined via setting knob 41 and setting shaft 42, which continuously determines the time and duration of the switching on, e.g. by adjusting the position of bimetal element 44 with respect to switch 43. On the operating side, adaptor switch 37 is mounted on the power control device 40 and contains two switching contacts 46, 47 operable by the setting shaft 42 of the energy regulator enabling one pole 48 of the domestic mains to be switched between the represented position, in which the terminal 38 is contacted, and a position in which the terminal 36 is applied to pole 48. In this position contact 46 connects one branch conductor 49, which branches off from branch conductor 50 and runs between heating resistor 34 and temperature limiter 17, to contact 38.

Thus, the following operation is possible: On switching the power control device to full power (100% relative on-time) by means of a corresponding setting by means of setting shaft 42, timing switch 43 of the power control device is closed and is not opened even on heating by metal element 44 by control heating system 45. Contact 47 of adaptor switch 37 applies the light radiator 20*a* to the pole 48 of the domestic mains, while the other pole 51 of the domestic mains applies line 49 and terminal 38 to both dark radiator heating resistors 34, 35 via closed switch 43 and the then closed switch of the temperature limiter 17 and the bridging contact 46. In turn, heating resistors 34, 35 are connected across center tap 33 to light radiator 22*a*. Thus, in this position the two conventional heating resistors 34, 35 are connected in parallel to one another, but jointly in series with the light radiator 20*a*. In the cold state, the light radiator has a very low resistance, so that the heating resistors 34, 35 act as series resistors and keep the starting current low. With increasing temperature of light radiator 20*a*, its resistance rises and the resistance proportion of the conventional heating resistors 34, 35 decreases. Thus, there is a heating of the two heating zones 27, 28, but prepondering in zone 28, which indicates to the user that there is rapid preheating in the enclosed circular region. This is maintained unless there is overheating of the glass ceramic plate, whereupon the total power can be switched off by temperature limiter 17.

On switching back to a lower heating state, which can start at 100% or e.g. 70% on-time, then automatically in adaptor switch 37 the contact is switched from terminal 36 to 38 and the contact 46 opens. As a result light radiator 20 is switched off and the two heating resistors 34, 35 are connected in series. In this lower power setting, they are timed and supplied with power, but the 100% power setting only releases 70% of the total power, because they are in series. As a result it is possible to reproducibly set low power values of approximately 4% of the on-time.

Figure 12:
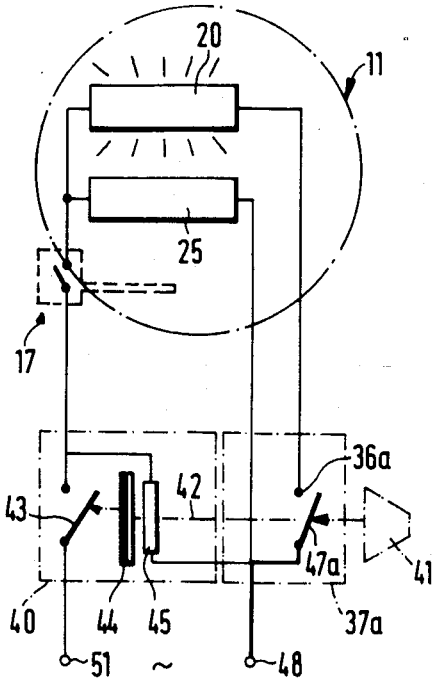
FIGS. 12 to 15 electric circuit diagrams of radiant heaters with associated power control devices.
Figure 15:
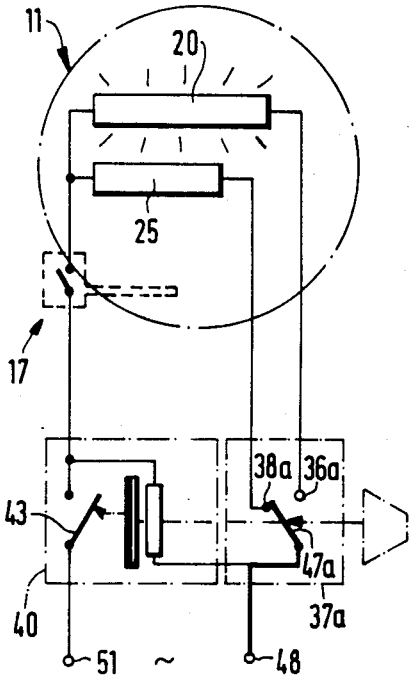

FIG. 12 shows a circuit, in which the radiant heater 11 has a light radiator 20 and a dark radiator 25. On one side they are both applied to mains pole 51 via temperature limiter 17 and the switch of the power control device 40, which is like that of FIG. 11. The other terminal of the light radiator 20 is applied to a contact 36*a* of an adaptor switch 37*a*, whose arrangement and operation are like that of adaptor switch 37 of FIG. 11, but which only requires one switching contact 47*a*, which is applied to the mains pole 48 and the other side of the dark radiator 25. In this embodiment, in the initial cooking stage, i.e. with power radiator 40 switched to permanent operation, light radiator 20 is switched on in parallel to the conventional heating resistor 25 and both are jointly monitored by the temperature limiter 17. In the case of a power setting below the maximum power setting, contact 47*a* opens and the dark radiator 25 is timed solely by the power control device. In the embodiment according to 15 and with an identical construction of the radiant heater with resistors 20, 25, switching in the adaptor switch 37*a* takes place so that the mains pole 48 is switched from contact 36*a* to contact 38*a* and consequently applies either the light radiator 20 only or the dark radiator 25 only to the mains and here again the timing, i.e. the partial power is only provided to the dark radiator 25. In the embodiments according to FIGS. 11, 12 and 15, the light radiator is consequently only switched on during full power or roasting/initial cooking operation and the partial power is provided by the dark radiator. Thus, the light radiator with its high starting current does not have to be timed, which could otherwise confuse the operator.

Figure 13:
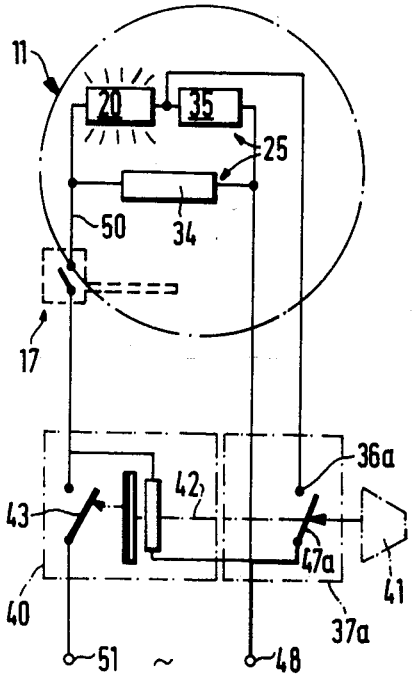

The embodiment according to FIG. 13 has the same power control device 40 with adaptor switch 37*a* as FIG. 12 and, with one exception, also connected in the same way. In the radiant heater, dark radiator 25 is subdivided into two partial resistors 34, 35, whereof one is connected between the mains pole 48 and the branch 50 coming from mains pole 51 via power timing switch 43 and temperature limiter 17, while the other is switched between the mains pole 48 and the light radiator 20, between which however a connecting line leads to contact 36*a*. In the case of the full power position (contact 47*a* closed), light radiator 20 and heating resistor part 34 are operated in parallel. While in the partial load setting (contact 47*a* open), partial resistor 35 is connected upstream of light radiator 20, so that the latter is timed in attenuated manner in its power and in lighting effect. This on the one hand protects the light radiator and ensures that it is less stressed by the timing operation and on the other hand the confusing effect of on/off lighting is attenuated.

Figure 14:
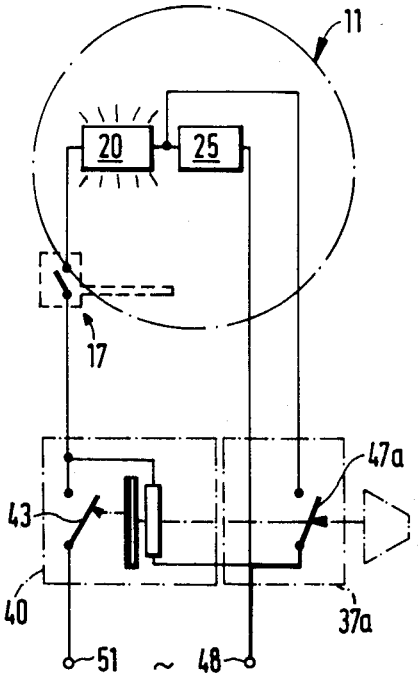

In FIG. 14, once again the same power control device 40 with adaptor switch 37*a* and radiant heater 11 has only one light radiator 20 (for several light radiators connected in parallel or series) can be switched together and one dark radiator 25, for which the same applies. They are switched or connected in such a way that with open contact 47*a* and closed timing switch 43 and temperature limiter 17, they are located in series, so that dark radiator 25 serves as a series resistor for light radiator 20. This is the partial power stage where, as in FIG. 13, there is an attenuation of the power and lighting effect of the light radiator while with contact 47*a* closed, i.e. for initial cooking in the full power stage, light radiator 20 is alone operated with full power.

It can be seen that particularly in FIGS. 12 to 15, in each case the same control element comprising power control device 40 and adaptor switch 37*a* can be used for the numerous different switching operations, so that using the same control means it is not only possible to operate different light - dark radiator combinations, but also other cooking appliances, e.g. cast cooking plates or conventional radiant heaters with an initial cooking stage. Due to the compatibility of the different cooking appliance variants, and the possibility of a unit assembly system between the control means and cooking plates, this has considerable importance. In most variants only three terminals are needed between the control means and the cooking plate 11 and a radiant heater is used which only has to supply part of the power as a light radiator, without it having to forego the light radiator effect of the light phenomenon and the rapid heating-up time, as well as the lower energy supply on disconnection. Most appliances (particularly FIGS. 12 and 13) permit a simplified 380 V construction and can be constructed with a reduced overall height.

FIGS. 16 and 17 show two rows of a radiant heater construction, which has in each case four heating resistors and which is switched by a per se known, seven-mode switch which is connected by means of four connecting leads to the radiant heater. Letters *a* to *f* for the integral drawings indicate the switching stages from full power *a* to the lowest partial power *f*. The design power of each heating resistor in watts is in each case given at *a* and the total power resulting from the circuit alongside the same and express reference is made thereto. The heating resistors in operation are indicated by hatching, the hatching spacing indicated when they are operted by a series connection of a lower power.

FIG. 16 only has one dark radiator 25 and three light radiators 20. At full power *a* all are in operation in parallel connection, whereas in stages *b, c* and *d* a three, two or one light radiator is in operation with its design power level. In stage *e*, one light radiator is connected upstream in series with a parallel-connected light radiator, whereas in the lowest setting *f*, there is still upstream series-connection of dark radiator 25. This leads to the advantage that in all positions, at least one light radiator is operating and the operator can gather the power stage from the configuration and light intensity. In addition, a conventional seven-mode switch can be used, as is commercially available for other hotplates.

FIG. 17 uses the same seven-mode switch in the same switching stages as is apparent from the power-connected ends, shown filled in. The difference is that there are only two light radiators 20 and two partial resistors 34, 35 for the dark radiator 25. Additionally a diode 55 is provided, which is bridged by a switch 56 in positions *a* to *e*. This circuit operates in accordance with FIG. 16, with the difference that only the conventional heating resistor 34 and none of the light radiators is switched in in power stage *d*. Compared with FIG. 16 merely one of the light radiators 20 is to be replaced by resistor 34. In the lowest position *f*, switch 56 is opened and diode 55 again halves the power, so that the lowest stage, with 93 W only, represents approximately 5% of the total installed power and consequently a keeping-warm stage is possible.

When it is not desired to use a commercial seven-mode switch, then in the configuration according to FIG. 17 with five independently switchable terminals, a construction can be obtained in which the diode become superfluous because then a series connection of all four radiators can lead to a very low power. There would also in this case be no need for the "dark" position d. The fact that in addition to light radiators, dark radiators are used not only leads to a saving on expensive light radiators, and improved control possibilities, but also ensures that the light phenomenon through the light radiators does not become too dazzling and that, particularly in the case of timed power levels, the power surges are attenuated somewhat in their action on the product being cooked, which would otherwise be prejudicial due to the limited heat supply occurring with light radiators.

Figure 18:
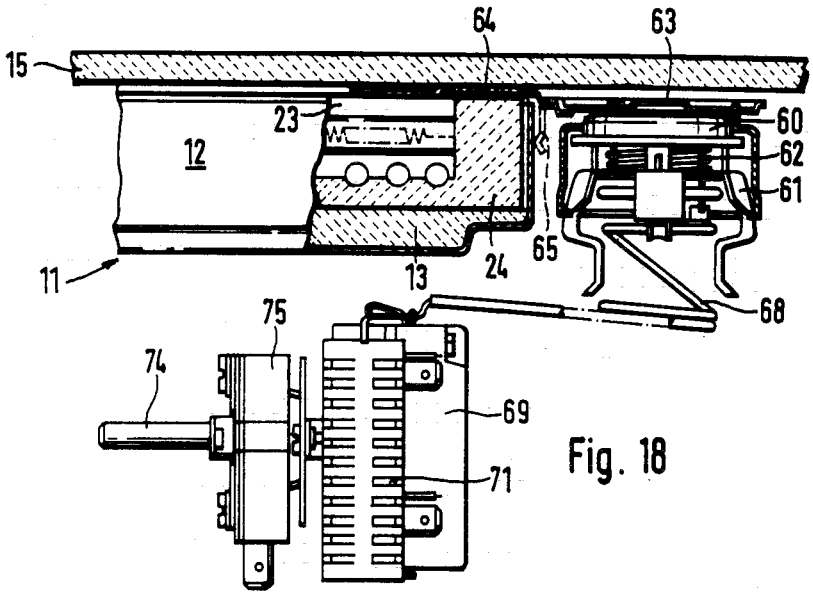
FIGS. 18 and 19 a part sectional side view and plan view of a radiant heater with a temperature regulator.
Figure 19:
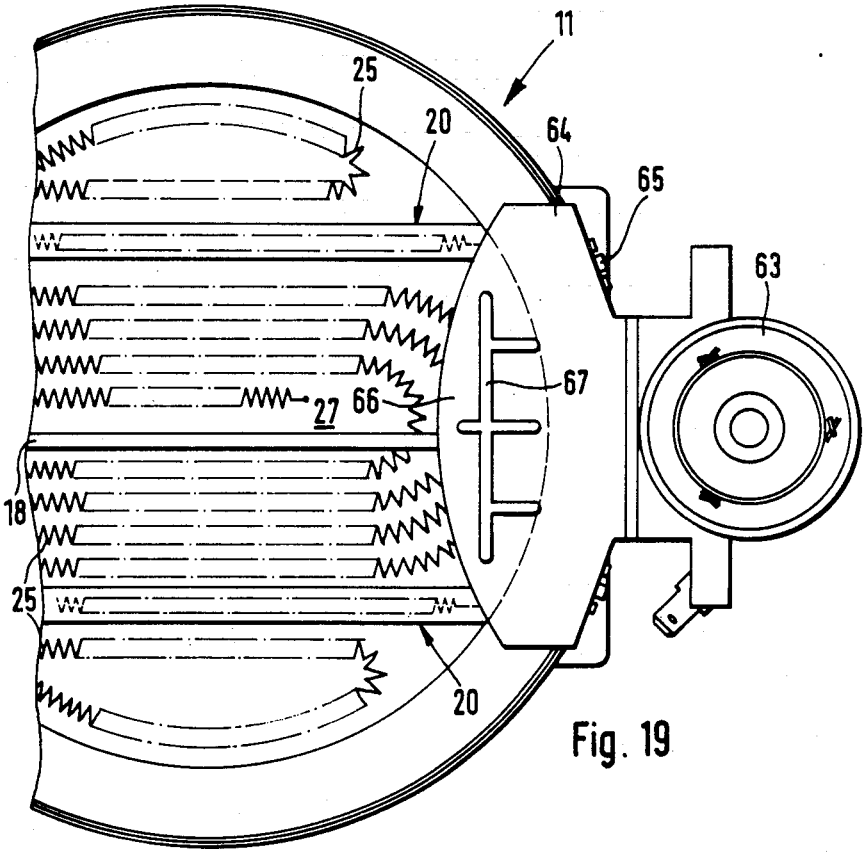

FIGS. 18 and 19 show a radiant heater 11 of the aforementioned type with light radiators 20 in parallel, spaced from one another approximately half the radiant heater diameter, and between them and in the remaining circular segments containing dark radiators 25. The straight light radiator tubes pass from edge to edge of the radiator 11. A straight rod-like heat sensor 18 of the temperature limiter 17 passes roughly centrally between the heat radiators 20 and parallel thereto over the central dark radiator heating zone 27.

Outside the edge of the radiant heater is provided for temperature control purposes, a heat sensor 60 in the form of a flat sensor box filled with expansion fluid. By means of a resilient locking mechanism 61 and a compressioin spring 62 located therein, it is pressed against the bottom of a portion 63 of a sheet metal heat transfer element 62 projecting over the heater edge 22. By means of a plug-in fastening 65, which comprises bent sheet metal tongues, it is mounted on the upper edge of the sheet metal tray 20 and projects between edge 22 and the bottom of the cooking surface 15 into the heated area 23, which it partially covers in a lenticular area 66 adjacent to the edge. The reinforcing seam arrangement 67 ensures increased rigidity. At inner area 66 and the area of edge 32, the heat transfer element engages flat on the hotplate and is heated from below by the dark radiator in the vicinity of which it is located in the same manner as the cooking surface 15, but also receives a certain, but very limited radiation proportion from the light radiators, so that it mainly receives the temperature of the dark radiator important for the temperature control, as well as a certain reactive effect from the cooking surface and cooking utensil. In the outer region, the heat sensor is protected against high temperatures, but still has a good access via the heat transfer element. Preferably the heat transfer element is made from an iron sheet which, on the side facing the cooking surface is plated with a roughly identically thick aluminium layer and contains on the opposite side a very thin aluminium layer. For further details of this sensor arrangement, express reference is made to European application No. 00,21,107 and German Utility Model 81,09,131 (equivalent to British Pat. No. 20,95,834).

Figure 20:
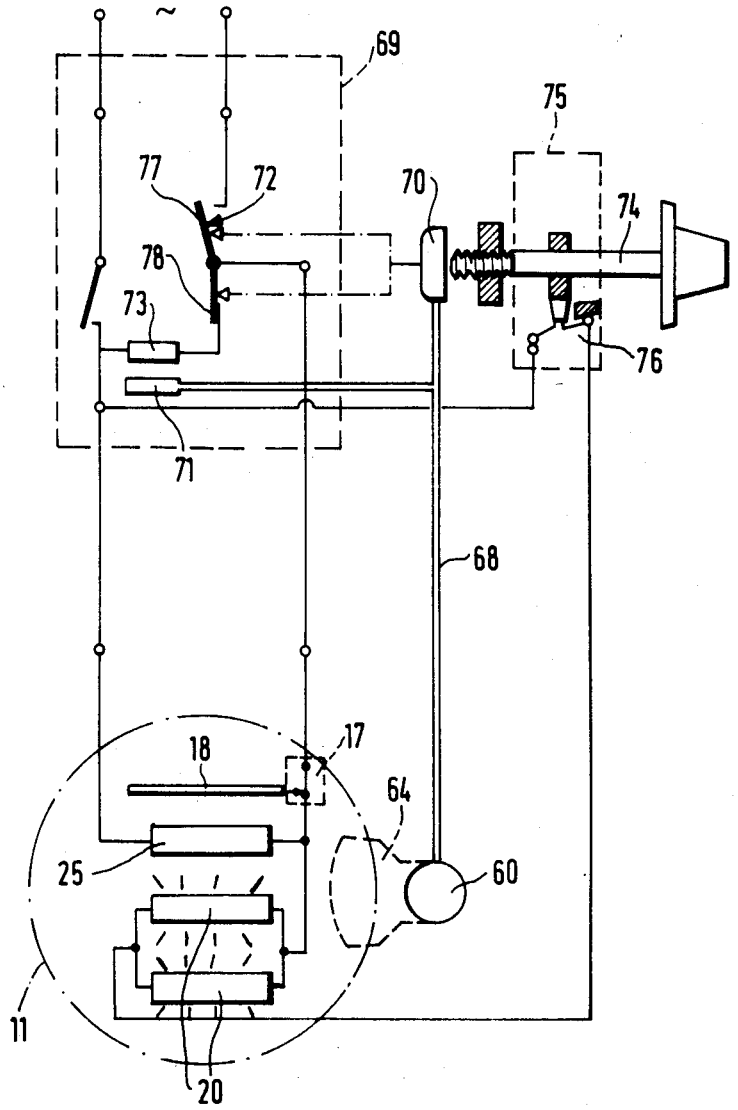
FIG. 20 a circuit diagram of the temperature-regulated radiant heater.

FIG. 18 also shows the temperature regulator 69 connected via a capillary tube 68 to the heat sensor 60 and whose circuit diagram and function will be explained relative to FIG. 20 and relative to which further details can be obtained from German publication No. 28,50,389 equivalent to British application No. (20 40 574). Temerature regulator 69 contains an expansion box 70 connected to capillary tube 68 and to which is also connected an expansion chamber 71, arranged in a vented space parallel to the regulator casing and which is heated by a control heating system 73. A double snap switch 72 (or two parallel snap switches) are operated by the expansion box, accompanied by simultaneously influencing by a setting or adjusting spindle 74. An adaptor switch 75, which is mechanically mounted on temperature regulator 69 and through which passes the setting shaft 74 which also operates it, contains a mechanical additional switch 76, which is only closed on setting the maximum regulating temperature or in the range thereof. It switches in the two light radiators 20 which then, in the same way as the dark radiator 25 which is not influenced by additional switch 76, are switched on and off in temperature-regulated timed manner by a contact 77. The second contact 78 of the temperature regulator switches in the control heating system specifically at a temperature value which is close to, but below the regulating temperature, but only together with the dark radiator. This leads to a timing temperature regulator, whose timing is switched off during the heating-up phase and is only switched in in the vicinity of the desired temperature shortly before reachiing the latter, this taking place automatically by means of the expansion member 70. Thus, heating up takes place just as quickly as in the case of an untimed temperature regulator, and due to its timing, the present temperature regulator allows much smaller divergences from the desired temperature in operation. Thus, the regulator is particularly suitable for glass ceramic plates and especially in conjunction with the described heat sensor fitting.

In the represented example, the temperature limiter 17 is connected in the common feedline for all the heaters and can therefore switch all of them off.

The previously described heat sensor arrangement and the arrangement of the light radiators explained hereinafter can be advantgeously used not only in the case of radiant heaters with a combination of light and dark radiators, but also in the case of radiant heaters containing only light radiators.

Figure 21:
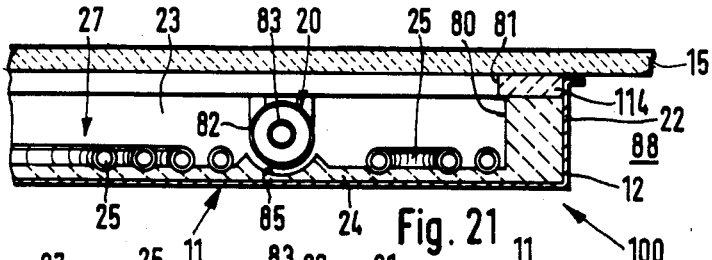
FIGS. 21 and 24 vertical partial sections through two variants of a radiant heater according to the invention.
Figure 22:
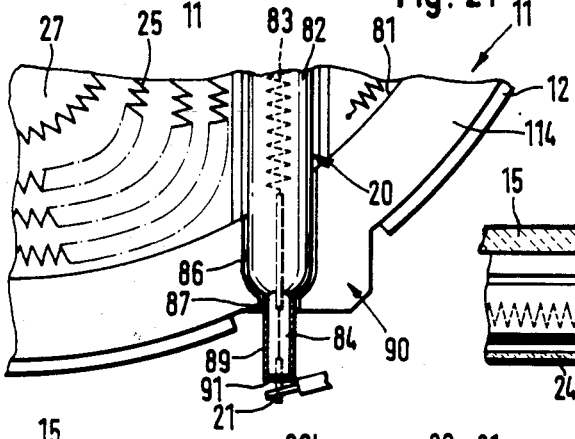
FIGS. 22 and 25 partial plan views of these radiant heaters.
Figure 23:
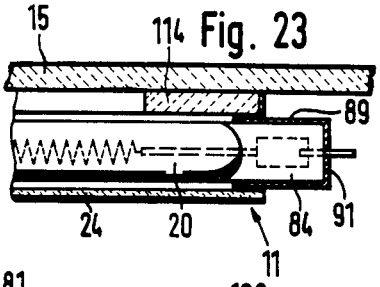
FIG. 23 and 26 vertical partial sections along section lines III or VI in the direction of the arrows.

FIGS. 21 to 23 show a radiant heater 11 positioned below a glass ceramic cooking surface 15. It heats the latter from below and consequently forms a cooking point on which cooking utensils can be heated.

The radiant heater 11 contains a dish-shaped insulating support 24 and is located in a sheet metal tray 12. On the edge 22 of the insulating support which is made from a high temperature resistant relatively good insulating material is placed a cover or mask 114 in the form of a ring, which is made from a high temperature resistant insulating material, which is denser and stronger than insulating support 25 and whose inner edge 81 projects somewhat inwards over the inner edge 80 of edge part 22. The upper surface of mask 114 engages on the bottom of cooking surface 15 and is generally pressed on to the same by spring tension acting on tray 12.

As insulating carrier 24 is normally made from a material with a high thermal insulatability, but which is not mechanically very strong, particularly in the edge area which is particularly stressed during manufacture and fitting, slight crumbling could easily occur in the vicinity of the unprotected inner edge 80 of edge part 82, which, particularly in the case of the subsequently described use of light radiator heating elements 20, could lead to an visible pattern with a frayed edge differing from the basic form (particularly circular form) of the cooking surface. This is in particular prevented by the sharp edge definition, particularly an inwardly projecting inner edge 81. It also prevents the penetration of visible radiation through the depression formed in the soft edge part and consequently the illumination of the area of the complete cooking implement 100 located outside the cooking surface. In addition, the mask 114 protects the edge part of the insulator against other mechanical influences.

In the embodiment, there are two light radiator heating elements 20 which can also be called high temperature heat radiators and, as described, comprise high temperature heating coils 83 enclosed in quartz envelopes 82 and which emit radiation well into the visible range and operate at temperatures well above 1500K. (approximately 1200° C.). They are in the form of elongated rods or tubular lamps, which are provided at both ends with a flattened portion 84, from which the connecting ends 21 project and are welded there to leads. In the example, two light radiators 20 are arranged in parallel, spaced manner, the spacing corresponding to roughly half the diameter of the radiant heater. Between them and in the circular segmental area of the heated region 23 formed within the radiant heater, between them and the edge part 22 are provided dark radiator heating elements 25, which comprise heating coils of conventional resistance materials used for radiant heaters, e.g. an iron - chrome - aluminium alloy, which can be used up to temperature of approximately 1500 K. (1200° C.) without encapsulation or an inert gas atmosphere. These heating coils are substantially spirally arranged in a form adapted to that of the particular dark radiator heating zone and are fixed by partial embedding in the insulating support material, e.g. according to German Pat. No. 27 29 929. Below light radiator 20, the insulating support, spaced from the light radiator 20, can have the form of a flat curved-limited channel 85, so as to obtained a planned reflection of the radiation. The light and dark radiators are switched in in parallel, series or individually, by selector switches, power or temperature control or regulating means. The light radiators are particularly connected in in the initial cooking range or in the higher power range, because it is here that they best reveal their advantages of a relatively low-pressure rapid heating.

FIGS. 22 and 23 show that the ends of the light radiators 20 are located in edge recesses 86, which are adapted to the shape of the light radiator tube and taper to an outer opening 87 constructed for receiving the flattened connection end 84 of the light radiator. This flattened end stands in a vertical manner, so that the light radiator is transversely and longitudinally guided in the edge recess 86, 87. In FIGS. 21 to 23, the edge recess is provided in edge 22 and is open to the top. Mask 81 covers the opening of the edge recess protecting it to the top, so that it is not visible from there. Part of the end portion 90 of light radiator 20 which comprises the flattened portion 84 and also an adjacent part of the untapered light radiator tube, partly and namely with the flattened portion 84 project out of the outer opening 87 and are electrically connected there. As a result of these flattened or squeezed flat end portions 84, a relatively large amount of light is emitted into the area 88 of the cooking appliance 100 located outside the radiant heater and would light up the inside of the glass ceramic fitting tray. As this is not only optically unattractive, it would lead to an inadmissible heating of the outer area 88 and to the thermal endangering of the leads or switching devices, the end portion and in particular the flattened portion 84, is coated with a light-absorbing or reflecting coating 89, which in particularly also covers the end faces 91 of the portion 84. This coating could in particular have e.g. an inwardly reflecting action and an outward black action for the radiation in question and could optionally comprise two superimposed coatings, e.g. an evaporated-on metal coating and a high temperature resistant varnish or paint coating applied thereto, as is used for coloring hotplates. At least that region projecting from outer opening 87 into space 88 must be covered with coating 89 but also further regions of end portion 90 can be coated, so that the vicinity of the edge recess 86, 87 has maximum protection against direct radiation. As a very desired side-effect, this leads to a temperature reduction in portion 84, which is very desirable because a critical point of halogen radiators is the temperature at the squeezing point through which the lead 21 is led outwards. If this temperature becomes too high, the sealing of the lamp could be prejudiced by oxidation at the passage point.

Figure 24:
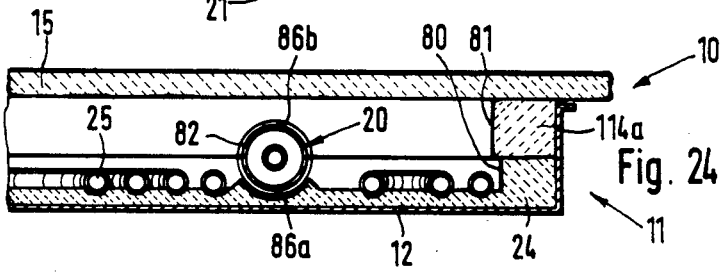
Figure 25:
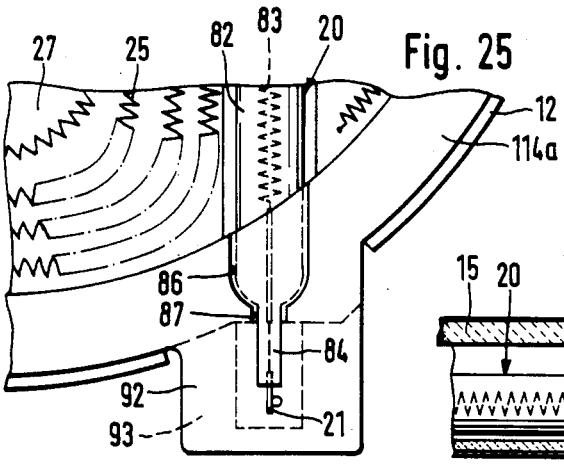
Figure 26:
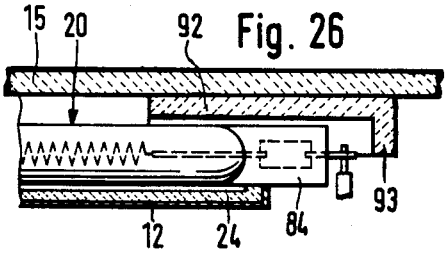

The construction according to FIGS. 24 and 25 coincides with that according to FIGS. 21 to 23 with the exception of the following differences. The cover or mask 114*a* comprises a relatively thick ring having an approximately square cross-section. Its inner edge 81 projects inwards over the inner edge 80 of edge part 22 of insulating support 24. However, the edge recesses for the two end portions of light radiator 20 are in each case subdivided into two parts, whereof part 86*a* is located in the vicinity of the insulated support 24 and part 86*b* is positioned in the vicinity of mask 114*a*. The same, substantially central subdivision applies with respect to the outer opening 87 for the flattened portion 84, so that by applying the mask 114*a* to the edge 22, light radiator 20is reliably fixed. Here again the flattened portion 84 has most of its length projecting out of outer opening 87. In this part is provided a cover 92 which is shaped as a projection on to mask 114 and partly surrounds with a good spacing the end portion in the upwards direction, to the two sides and in the vicinity of the end face. The shielding of end face 91 is particularly important, because the radiation passes particularly intensely therefrom, in the manner of a light guide. The edges 93 of cover 92 surrounding edge portion 84 extend in the represented example up to the lower plane of mask 114*a* and consequently up to the median plane of the light radiator. This jointing plane can also be positioned further upwards or preferably further downwards with respect to the light radiator, so that edge 93 even further surrounds the end portion 90. Importance is attached to the spacing by which the light radiator end is surrounded, so that from there a heat dissipation is possible and over heating of the end is prevented. Particular preference is given to a combination of the two embodiments with cover 92 and layer 89.

On producing the mask with cover 92, it must be ensured that in particular the cover 92 is substantially opaque, which which can be brought about by a special consolidation of the materials, e.g. ceramic fibers of aluminium dioxide known under the trade name Fiberfrax or by means of a corresponding opaque coating or both of these together. As the impermeability to light is also desired for the mask, this can be achieved by corresponding coloring or the choice of an absorbing binder. The mask material should be hardened by mineral binders so that on the inner edge portion the precise edge determining the optical edge part of the cooking surface is obtained. With the arrangement in which only the flattened end portion projects through the outer opening 87, a large part of the scattered light is shielded in the vicinity of edge recess 86. However, it would also be possible to permit the projection of all the flattened portion 84 although its incorporation into the edge recess permits the reliable guidance of the halogen lamp, also against twisting, which is e.g. important if the light radiator is provided with a reflecting coating on the outside or inside of its envelope 82. It is particularly advantageous that the arrangement according to the invention obviates the need for expensive end bases. Due to the irradiation conditions from the light radiator end portions 90, particular importance is attached to the end part 93 of cover 92, because it holds back most of the undesired radiation. It would also be possible to form the cover from the material of insulating support 24, on ensuring a corresponding compression and light-impermeability, together with adequate venting of the end. It would also be possible to provide covering parts on the ring and insulating support, whereby the size of their edge part would e.g. differ in such a way that although overlapping in height, they receive a sufficient gap between them for venting purposes. This would lead to a labyrinth-like cover, which would substantially permit no light emission. Thus, e.g. on the insulating support, the cover could be provided with the basic form of cover 92 of FIG. 25, whereas the cover on mask 114*a* would have a larger edge part and would project in spaced manner over the cover provided below it.

What is claimed is:

1. A radiant heater for cooking appliances with a cooking surface, comprising:

at least one electric visible light radiator heating element, which operates at an elevated temperature above 2200° F. (approximately 1200° C.) and whose radiation spectrum is mainly in the visible range;

a darker infrared radiator heating element operating at temperatures below 2200° F. (approximately 1200° C.), the darker radiator having a radiation spectrum mainly in the infrared range;

the at least one visible light radiator heating element and the at least one darker infrared radiator heating element being connected in series with one another.

2. A radiant heater according to colaim 1, wherein the light radiator is made from a resistance material based on molybdenum disilicide ($MoSi_2$).

3. A radiant heater according to claim 1, further comprising a control means operable to connect the visible light radiator and the darker infrared radiator to sources of electrical power in power ranges including an initial cooking and roasting power range, and a continuous cooking power range, and wherein the at least one visible light radiator is in operation in the initial cooking and roasting power range, while in the continuous cooking power range only the at least one darker radiator is switched in.

4. A radiant heater according to claim 1, comprising at least two of the darker radiators, the darker radiators being normally connected in parallel with one another and in series with the visible light radiator, and the darker radiators being connected in series with one another in a continuous cooking power range.

5. A radiant heater according to claim 1, wherein only the darker radiators are provided in a central region of the radiant heater, being surrounded by an annular area receiving the visible light radiator.

6. A radiant heater according to claim 5, comprising straight visible light radiators arranged in polyangular configuration around heating zones occupied by the dark radiators.

7. A radiant heater according to claim 1, wherein the visible light radiators project linearly through a heated region of the radiant heater, and between the visible light radiators are defined heating zones heated with the dark radiators.

8. A radiant heater according to claim 7, wherein the visible light radiators are arranged in a vicinity of spaces between insulating supports carrying the dark radiators.

9. A radiant heater according to claim 1, wherein the dark radiators are mounted in the radiant heater by partial embedding on insulating supports which are fitted between the visible light radiators, parallel to the visible light radiators.

10. A radiant heater according to claim 1, further comprising a reflecting coating applied to an insulator arranged below the visible light radiators in a zone occupied by the visible light radiators.

11. A radiant heater according to claim 1, further comprising a temperature limiter, the temperature limiter having a rod-like heat sensor, the heat sensor being arranged over a zone defined by the dark radiators.

12. A radiant heater according to claim 11, wherein the heat sensor is arranged parallel to a visible light radiator and adjacent thereto.

13. A radiant heater according to claim 1, further comprising a temperature limiter which switches off the dark radiators, the visible light radiator remaining energized as a residual power consumer.

14. A radiant heater according to claim 1, further comprising a temperature switch connected in series with the visible light radiator, the temperature switch being set to a temperature corresponding to an initial cooking temperature and having such a large switching delay that after switching off once, the temperature switch does not switch in again throughout operation of the radiant heater.

15. A radiant heater according to claim 1, further comprising a power control device for timing power to the visible light and dark radiators, the power control device being provided with an additional switch, manually switchable by means of a setting shaft of the power control device and which switches in the at least one visible light radiator in an upper power range.

16. A radiant heater according to claim 1, having at least an upper, middle and lower power range, and wherein in the middle and lower power range, the series connected visible light and dark radiators are supplied with power in timed manner by a power control device.

17. A radiant heater according to claim 1, comprising a plurality of visible light radiators and wherein power to the plurality of visible light radiators and the at least one dark radiator is controlled by a multi-step-control switch operable to switch at least some of the radiators in parallel, individual and series connections.

18. A radiant heater for cooking appliances with a cooking surface, comprising:

a least one electric visible light radiator heating element, which operates at an elevated temperature above 2200° F. (approximately 1200° C.) and whose radiation spectrum is mainly in the visible range;

at least one darker infrared radiator heating element, which operates at an elevated temperature below 2200° F. (approximately 1200° C.) and whose radiation spectrum is mainly in the infrared range, the darker radiator heating element being connected in series with the light radiator heating element;

a temperature regulator including a heat sensor, the temperature regulator having a pulsing power output, the temperature regulator regulating the dark radiators; and, an additional switch operable together with the temperature regulator, said additional switch being operable to switch in at least one visible light regulator in the vicinity of a maximum regulating temperature.

19. A radiant heater according to claim 18, wherein the visible light radiators can all be switched in by the additional switch and wherein at least some of the light radiators and dark radiators are regulatable in pulsing manner by a regulating contact of the temperature regulator.

20. A radiant heater according to claim 1, further comprising a heat sensor with a heat transfer element formed of a metal sheet which in an edge region of the radiant heater covers a portion of at least one of the dark radiators and is disposed between the dark radiators, and in contact with the cooking surface, and wherein the heat sensor is constructed as a sensor box filled with an expansion fluid, the sensor box being positioned outside the radiant heater in thermal contact with a heat transfer element.

21. A radiant heater according to claim 1, further comprising a radiation shield provided in an edge region of the radiant heater.

22. A radiant heater according to claim 21, wherein the radiation shield protects end portions of the light radiator against an area of the cooking appliance located outside the radiant heater.

23. A radiant heater according to claim 21, further comprising an insulator, an edge part of the insulator being covered by a radiation shield constructed as a substantially circular insulating mask, which faces the cooking surface.

24. A radiant heater according to claim 23, wherein the mask is made from an insulating material with a higher strength than an insulator positioned below the mask.

25. A radiant heater according to claim 23, wherein the mask protects inwards at a sharply defined inner periphery of the mask, over a corresponding inner periphery of an edge part of the insulator.

26. A radiant heater according to claim 23, wherein the mask has a relatively limited height compared with a width of a ring defined by the periphery of the insulator.

27. A radiant heater according to claim 21, wherein at least one edge portion of the visible light radiator heating element located in a recess of an edge of the radiant heater is provided with a light blocking coating forming a radiation shield.

28. A radiant heater according to claim 21, wherein at least one end portion of the visible light radiator heating element is surrounded on an upward surface thereof, at least partly laterally and in a vicinity of an end face of an end portion by a cover forming a radiation shield connected to a recess in an edge of the radiant heater.

29. A radiant heater according to claim 22, wherein the cover defines part of a thermal insulator of the radiant heater.

30. A radiant heater according to claim 21, wherein an edge recess is provided in an edge part of an insulator and is open to the top of the insulator.

31. A radiant heater according to claim 24, wherein at least some parts of the cover are provided on the mask.

32. A radiant heater according to claim 31, wherein the mask at least contains part of the edge recess.

33. A radiant heater according to claim 32, wherein a part of the cover facing the cooking surface and a covering part of the end portion of the light radiator heating element have an all round edge part open to its bottom.

34. A radiant heater according to claim 22, wherein the cover at least partly surrounds a portion of the visible light radiator heating element arranged therein and is spaced therefrom.

35. A radiant heater according to claim 22, wherein a cross-sectionally reduced portion at an end of the visible light radiator heating element projects through a matchiing slot-like outer opening of a recess in the edge of the radiant heater.

* * * * *